US007651574B2

(12) United States Patent
Shull et al.

(10) Patent No.: US 7,651,574 B2
(45) Date of Patent: Jan. 26, 2010

(54) DOPED $GD_5GE_2SI_2$ COMPOUNDS AND METHODS FOR REDUCING HYSTERESIS LOSSES IN $GD_5GE_2SI_2$ COMPOUND

(75) Inventors: Robert D. Shull, Boyds, MD (US); Alexander J. Shapiro, Rockville, MD (US); Virgil Provenzano, Gaithersburg, MD (US)

(73) Assignee: The United States of America as represented by the Secretary of Commerce, the National Institute of Standards and Technology, Washington, DC (US)

( * ) Notice: Subject to any disclaimer, the term of this patent is extended or adjusted under 35 U.S.C. 154(b) by 425 days.

(21) Appl. No.: 11/262,270

(22) Filed: Oct. 27, 2005

(65) Prior Publication Data

US 2006/0144473 A1 Jul. 6, 2006

Related U.S. Application Data

(60) Provisional application No. 60/641,168, filed on Jan. 4, 2005.

(51) Int. Cl.
*H01F 1/00* (2006.01)

(52) U.S. Cl. ..... 148/121; 420/578

(58) Field of Classification Search ..... 148/121; 420/578

See application file for complete search history.

(56) References Cited

U.S. PATENT DOCUMENTS 7,114,340 B2 * 10/2006 Pecharsky et al. ..... 62/3.1

OTHER PUBLICATIONS

Pecharsky et al (NPL: Effect of alloying on the giant magnetocaloric effect of Gd5(Si2Ge2), J. Magn. Magn. Mater. 167 (1997) L179-184, Thereafter, NPL-1).*

Zhuang et al (NPL: Giant magnetocaloric effect enhanced by Pb-doping in Gd5Si2Ge2 compound, Journal of alloy and compounds 421 (2006) pp. 49-53, thereafter NPL-2).*

V. Provenzano, A. J. Shapiro, R.D. Shull, *Reduction of Hysteresis Losses in the Magnetic Refrigerant Gd5Ge2Si2 by the Addition of Iron*, Nature Publishing Group, vol. 429, Jun. 2004.

* cited by examiner

*Primary Examiner*—Roy King
*Assistant Examiner*—Jie Yang
(74) *Attorney, Agent, or Firm*—Kermit D. Lopez; Matthew F. Lambrinos; Luis M. Ortiz

(57) ABSTRACT

A $Gd_5Ge_2Si_2$ refrigerant compound is doped or alloyed with an effective amount of silicide-forming metal element such that the magnetic hysteresis losses in the doped $Gd_5Ge_2Si_2$ compound are substantially reduced in comparison to the hysteresis losses of the undoped $Gd_5Ge_2Si_2$ compound. The hysteresis losses can be nearly eliminated by doping the $Gd_5Ge_2Si_2$ compound with iron, cobalt, manganese, copper, or gallium. The effective refrigeration capacities of the doped $Gd_5Ge_2Si_2$ compound are significantly higher than for the undoped $Gd_5Ge_2Si_2$ compound.

5 Claims, 10 Drawing Sheets

Co

Cu

Ga

Mn

22

| Compound | Refrigeration Capacity for ΔH=5 T | Net Capacity |
|---|---|---|
| $Gd_5Ge_{1.9}Si_2Cu_{0.1}$ | 359 J/kg | 359 J/kg |
| $Gd_5Ge_{1.9}Si_2Ga_{0.1}$ | 305 J/kg | 305 J/kg |
| $Gd_5Ge_{1.9}Si_2Mn_{0.1}$ | 320 J/kg | 320 J/kg |
| $Gd_5Ge_{1.9}Si_2Co_{0.1}$ | 368 J/kg | 353 J/kg |
| $Gd_5Ge_{1.9}Si_2Fe_{0.1}$ | 360 J/kg | 355 J/kg |
| $Gd_5Ge_2Si_2$ (Ames) | 305 J/kg | 240 J/kg |

Fig. 9

DOPED $GD_5GE_2SI_2$ COMPOUNDS AND METHODS FOR REDUCING HYSTERESIS LOSSES IN $GD_5GE_2SI_2$ COMPOUND

REFERENCE TO RELATED APPLICATION

This patent application claims priority under 35 U.S.C. §119(e) to provisional patent application Ser. No. 60/641,168 entitled "Near-Elimination of Large Hysteresis Losses in the $Gd_5Ge_2Si_2$ Alloy by Small Silicide Forming Metal Addition Resulting in a Much Improved Magnetic Refrigerant Material" which was filed on Jan. 4, 2005, the disclosure of which is incorporated herein by reference provisional patent application.

TECHNICAL FIELD

Embodiments are generally related to magnetic refrigerant compounds and, in particular, to Gd—Ge—Si containing compounds. Embodiments are also related to methods of preparing $Gd_5Ge_2Si_2$ doped alloys. Embodiments are additionally related to methods of reducing hysteresis losses in the $Gd_5Ge_2Si_2$ compound.

BACKGROUND OF THE INVENTION

Magnetic refrigeration is in principle a much more efficient technology than conventional vapor compression refrigeration technology as it is a reversible process and, moreover, it does not use environmentally unfriendly ozone-depleting chlorofluorocarbon refrigerants (CFCs). Magnetic refrigeration depends on the magnetocaloric effect (MCE), utilizing the entropy of magnetic spin alignment for the transfer of heat between reservoirs.

Since the late nineties, the use of a $Gd_5Ge_2Si_2$ compound in near-room temperature magnetic refrigeration applications has attracted attention owing to its potential as a suitable refrigerant material for near room temperature magnetic refrigeration. A large magnetocaloric effect in the $Gd_5Ge_2Si_2$ compound in the 270-300 K temperature range has been reported by Gschneidner, Pecharsky and their coworkers in the following published references: Pecharsky, V. K. & Gschneidner, K. A., Jr., "The Giant Magnetocaloric Effect in $Gd_5(Ge_2Si_2)$", *Phys. Rev. Lett.* 78, 4494-4497 (1997), Pecharsky, A. O., Gschneidner, K. A., Jr., "The Giant Magnetocaloric Effect of Optimally Prepared $Gd_5Ge_2Si_2$", *J. Appl. Phys.* 93, 4722-4728 (2003), and Pecharsky, V. K. & Gschneidner, K. A., Jr "The Giant Magnetocaloric Effect in $Gd_5(Si_xGe_{1-x})_4$ Materials for Magnetic Refrigeration", *Advances in Cryogenic Engineering,* 43, edited by P. Kittel, Plenum Press, New York, 1729-1736 (1998).

The aforementioned references disclosed that the large magnetocaloric effect observed in the $Gd_5Ge_2Si_2$ compound, in the 270-320 K temperature range, is the result of a magnetic field-induced crystallographic phase change from the high-temperature paramagnetic monoclinic phase to the low-temperature ferromagnetic orthorhombic phase. Unfortunately, large hysteresis losses were also observed in the $Gd_5Ge_2Si_2$ magnetic refrigerant compound in the 270-320 K temperature range. These large hysteretic losses occurred at the same temperature range where the compound exhibits a pronounced magnetocaloric effect, referred as "The giant magnetocaloric effect".

Choe, W. et al, and other researchers have proposed that the large magnetocaloric effect is the result of a field-induced crystallographic phase change from the high temperature paramagnetic monoclinic phase to the low-temperature ferromagnetic orthorhombic phase (see Choe, W. et al, "Making and Breaking Covalent Bonds across the Magnetic Transition in the Giant Magnetocaloric Material $Gd_5(Ge_2Si_2)$", *Phys. Rev. Left.* 84, 4617-4620 (2000), Pecharsky, V. K. & Gschneidner, K. A., Jr., "Phase relationship and crystallography in pseudobinary system $Gd_5Si_4$—$Gd_5Ge_4$", *J. Alloys and Compd.* 260, 98-106 (1997), and Pecharsky, V. K., Pecharsky, A. O., and Gschneidner, K. A., Jr., "Uncovering the structure-property in $R_s(Si_xGe_{4-x})$ intermetallics phases", *J. Alloys and Compd.* 344, 362-368 (2002).)

Other studies by Pecharsky et al and by other researchers have also observed the magnetocaloric effect of the $Gd_5Ge_2Si_2$ magnetic refrigerant compound and the hysterisis losses behavior (See Pecharsky, V. K. & Gschneidner, K. A., Jr. "Tunable magnetic regenerator alloys with a giant magnetocaloric effect for magnetic refrigeration from 20 to 290 K", *Appl. Phys. Lett.* 70, 3299-3301 (1997), Levin, E. M., Pecharsky, V. K., and Gschneidner, K. A., Jr. "Unusual magnetic behavior in $G_5(Ge_{1.5}Si_{2.5})$ and $G_5Ge_2Si_2$", *Phys. Rev.* B 62, RI4 625-R14 628 (2000), Giguere, A. et ai. Direct Measurements of the 'Giant' Adiabatic Temperature, Change in $G_5Ge_2Si_2$", *Phys. Rev. Left.* 83, 2262-2265 (1999).

There is a need to greatly reduce or eliminate the large hysteresis losses in the $G_5Ge_2Si_2$ compound so that the potential of the compound as an efficient and attractive refrigerant material for near-room temperature magnetic refrigeration can be fully realized.

The embodiments disclosed herein therefore directly address the shortcomings of present $Gd_5Ge_2Si_2$ magnetic refrigerant compounds, providing an alloy that is suitable for near-room temperature magnetic refrigeration applications.

BRIEF SUMMARY

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is, therefore, one aspect of the present invention to provide for an improved magnetic refrigerant material.

It is another aspect of the present invention to provide for a Gd—Ge—Si containing alloy suitable for near-room temperature magnetic refrigeration applications.

It is a further aspect of the present invention to provide for a method of preparing a doped $Gd_5Ge_2Si_2$ alloy.

It is yet an additional aspect of the present invention to provide for a method of reducing large hysterisis losses in the $Gd_5Ge_2Si_2$ containing alloy.

The aforementioned aspects of the invention and other objectives and advantages can now be achieved as described herein.

In one aspect, a method of reducing hysterisis in a $Gd_5Ge_2Si_2$ refrigerant compound is provided. The $Gd_5Ge_2Si_2$ compound is doped or alloyed with an effective amount of a silicide-forming metal element such that the magnetization hysterisis losses in the doped $Gd_5Ge_2Si_2$ compound are substantially reduced in comparison to the hysterisis losses of the undoped $Gd_5Ge_2Si_2$ compound. By adding a silicide-forming metal to the $Gd_5Ge_2Si_2$ compound in this manner, a magnetic refrigerant material highly suitable for near-room temperature applications is provided.

About one atomic percent of said silicide-forming metal can be added to the $Gd_5Ge_2Si_2$ compound in order to reduce hysteresis losses by more than 90 percent compared to the undoped $Gd_5Ge_2Si_2$ compound. Additionally, the resulting doped $Gd_5Ge_2Si_2$ compound exhibits significantly higher calculated effective refrigerant capacities than the $Gd_5Ge_2Si_2$ compound without silicide-forming metal additives.

The silicide-forming metal element can comprise at least one metal selected from a group of materials that includes one or more of the following: iron (Fe), cobalt (Co), manganese (Mn), copper (Cu), or gallium (Ga). When the silicide-forming metal element consists of Mn, Cu, or Ga, the hysterisis losses are reduced by near 100 percent, that is, the hysterisis losses are nearly eliminated.

In another aspect, the $Gd_5Ge_2Si_2$ compound alloyed with the silicide-forming metal additive is prepared by means of arc melting mixtures of the compound elements and silicide-forming metal element. The $Gd_5Ge_2Si_2$ compound alloyed with the silicide-forming metal additive is then heat treated so as to homogenize the compound.

In yet another aspect, there is provided a magnetic refrigerant alloy of the general formula: $Gd_5Ge_{1-X}Si_2M_X$, wherein M is a silicide-forming metal element; and wherein x is an effective number selected such that hysterisis loss in the alloy is substantially smaller than when x=0.

X can be about 0.1. M can be at least one metal selected from the group consisting of Fe, Co, Mn, Cu, or Ga.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIGS. 1(*b*) and 1(*c*) depict backscattered SEM micrographs of the $Gd_5Ge_{0.9}Si_2Fe_{0.1}$ alloy heat treated in vacuum at 1300° C. for 1 hour according to one embodiment;

FIG. 9 depicts a table of computed Refrigeration Capacity (RC) and corresponding Effective Refrigeration Capacity (ERC) values for the compound $Gd_5Ge_2Si_2$ doped with different metal additives.

DETAILED DESCRIPTION OF THE INVENTION

The particular values and configurations discussed in these non-limiting examples can be varied and are cited merely to illustrate at least one embodiment and are not intended to limit the scope of the invention.

The method for reducing the hysteresis losses in the $Gd_5Ge_2Si_2$ refrigerant compound consists of alloying or doping the $Gd_5Ge_2Si_2$ compound with either a small amount of either iron or other silicide-forming metal additive, such as manganese, cobalt, copper, or gallium.

As will be described in more detail below, alloying the compound with a very small amount of the silicide-forming metal additive, results in the reduction of the hysteresis losses by more than 90 percent and for some of the metal additives, the reduction is nearly 100 percent.

For the purpose of discussion hereinafter, the term "metal additive" refers to iron or other silicide-forming metal additive.

According to one embodiment, the $Gd_5Ge_2Si_2$ refrigerant compound doped or alloyed with iron was prepared by arc melting the appropriate elemental mixtures, using a water-cooled copper hearth in an argon atmosphere under ambient pressure. The purity of the starting constituents was 99.9 wt. % and the chemical composition of the alloy resulting doped compound was $Gd_5Ge_{1.9}Si_2Fe_{0.1}$. Also for the purpose of comparison, a $Gd_5Ge_2Si_2$ refrigerant compound was prepared by the same arc melting process but without the metal additive. Prior to making magnetic measurements, using a SQUID magnetometer, each alloy was homogenized for one hour at 1300° C. in vacuum.

Figures 1A, 1B, 1C:
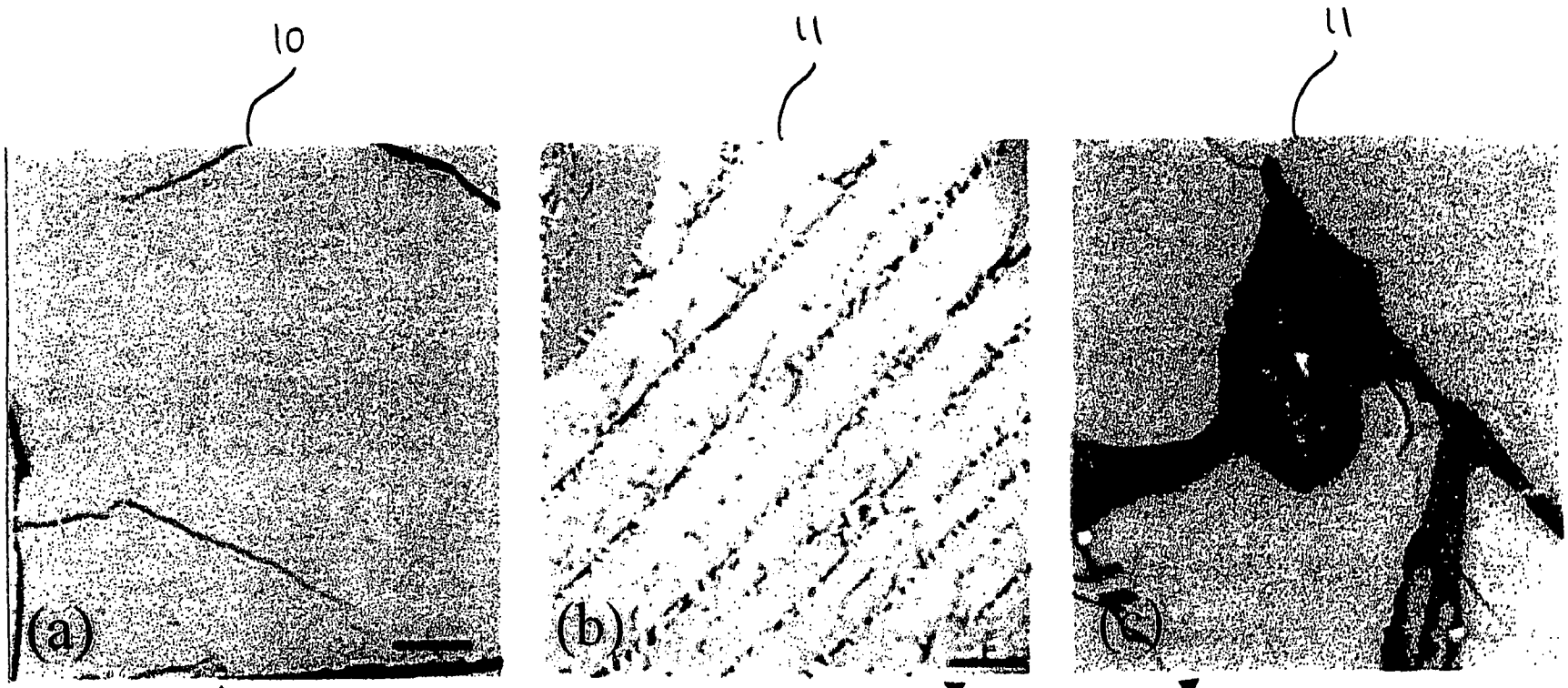
FIG. 1(*a*) depicts a backscattered SEM micrograph of a typical microstructure of the $Gd_5Ge_2Si_2$ alloy heat treated in vacuum at 1300° C. for 1 hour.
Figure 2A:
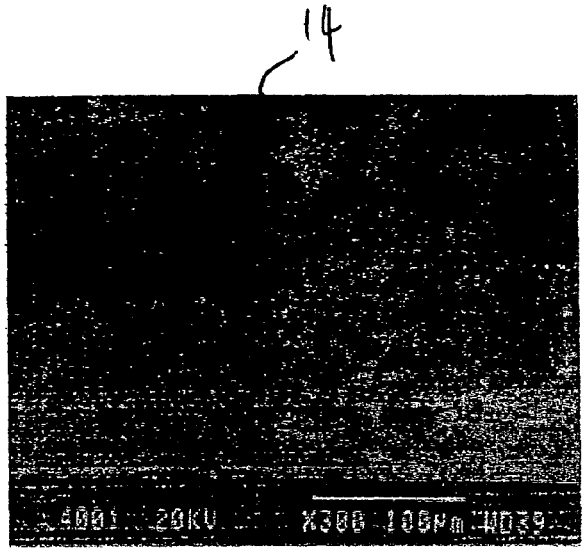
FIGS. 2(*a*) to (*d*) respectively depict backscattered SEM micrographs of the $Gd_5Ge_2Si_2$ compound doped with cobalt, copper, gallium, and manganese according to different embodiments.
Figure 2B:
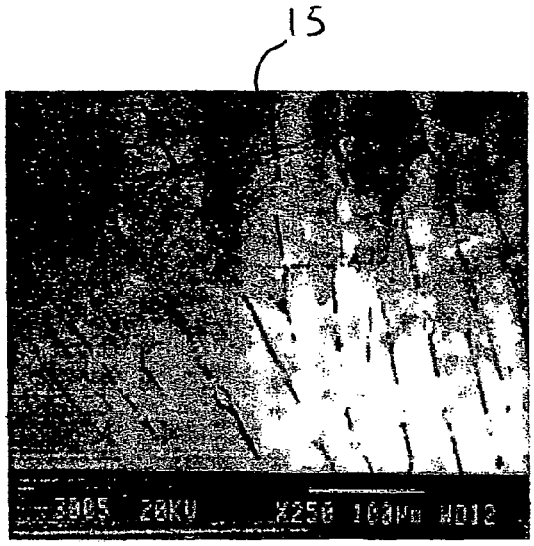
Figure 2C:
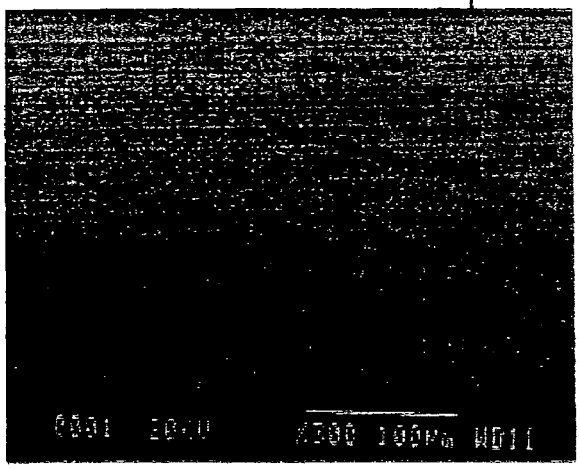
Figure 2D:
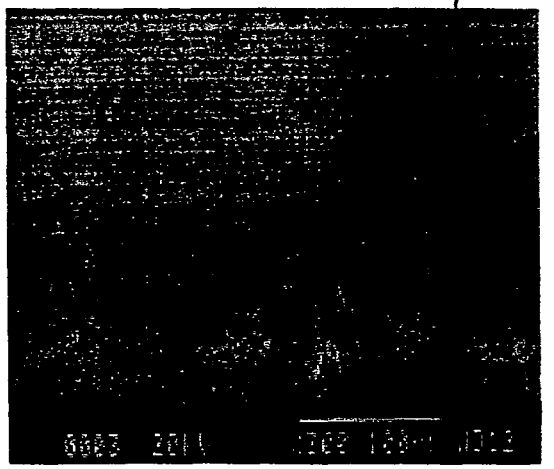

Referring to FIG. 1(*a*) of the accompanying drawings, which depicts, a backscattered SEM micrograph of a typical microstructure of the heat treated $Gd_5Ge_2Si_2$ compound, and FIGS. 1(*b*) & 1(*c*), which depict backscattered SEM micrographs of the heat treated $Gd_5Ge_{1.9}Si_2Fe_{0.1}$ alloy according to one embodiment, the micrographs show that the $Gd_5Ge_2Si_2$ compound 10 is single phase, whereas the $Gd_5Ge_{1.9}Si_2Fe_{0.1}$ alloy 11 is multiphase, with a dominant light gray phase surrounded by a darker minor intergranular phase.

Figure 3:
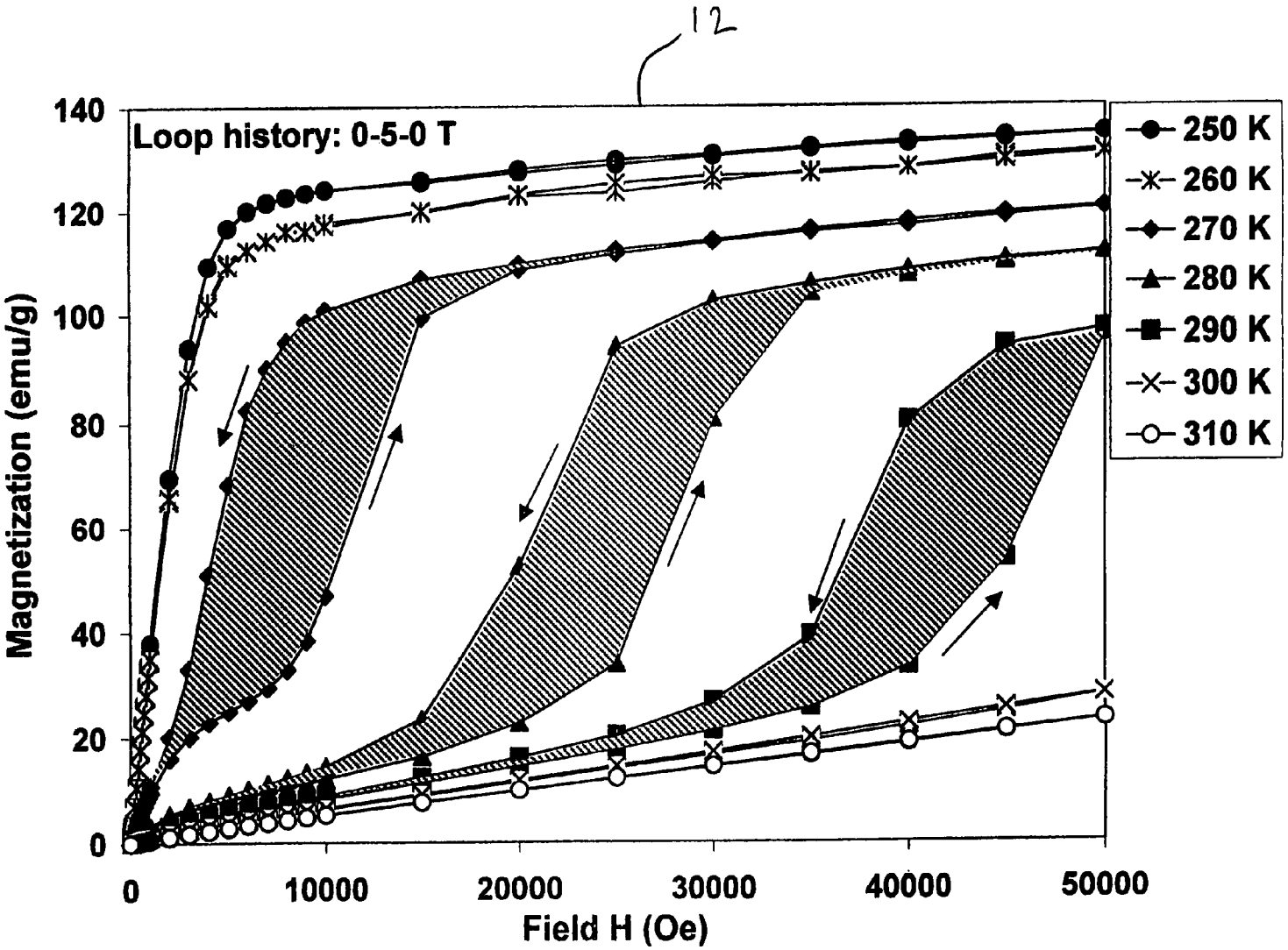
FIG. 3 depicts a graph of magnetization versus field loops of the $Gd_5Ge_2Si_2$ compound heat treated in vacuum at 1300° C. for 1 hour.
Figure 4:
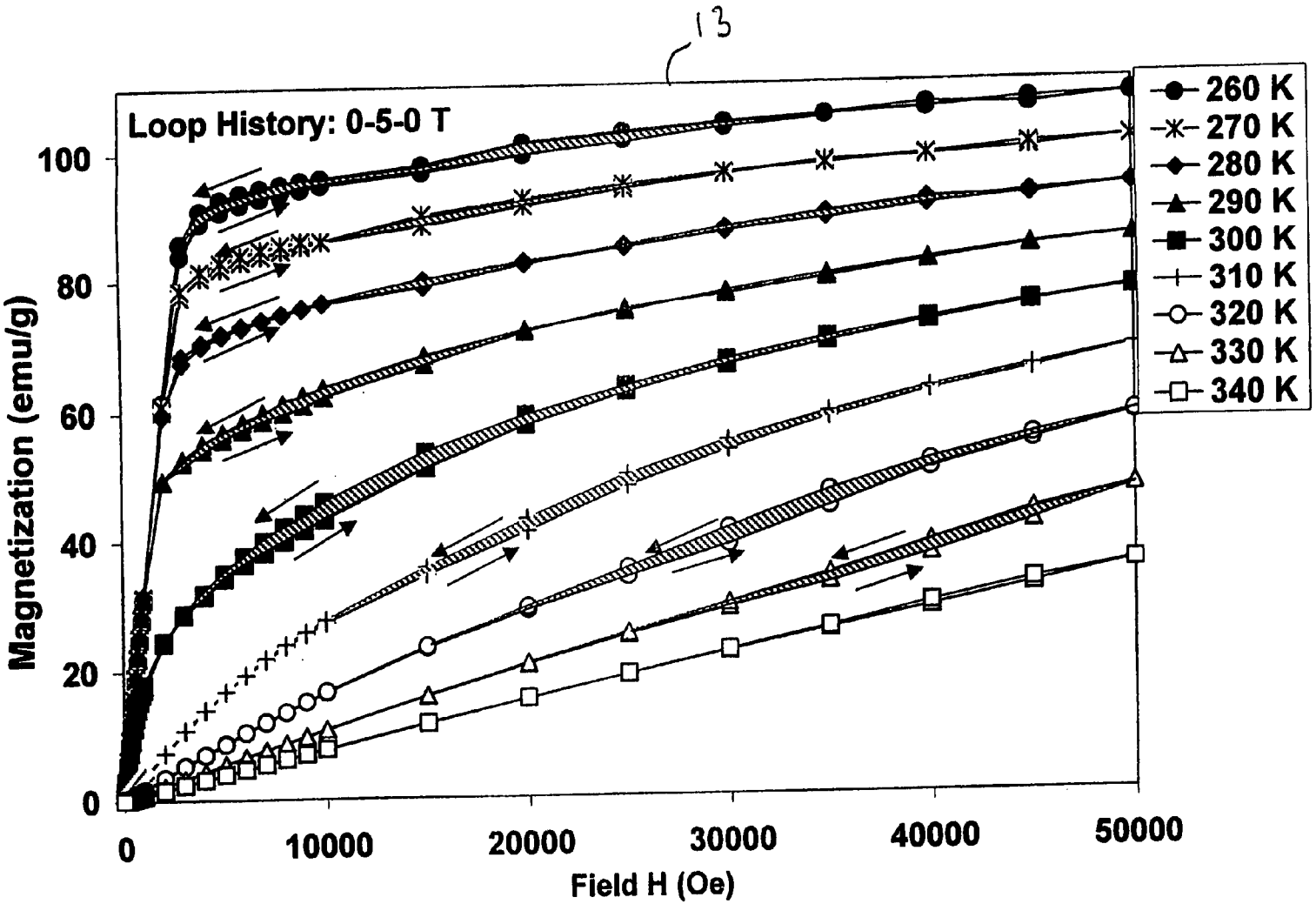
FIG. 4 depicts a graph of magnetization versus field loops of the $Gd_5Ge_{1.9}Si_2Fe_{0.1}$ alloy heat treated in vacuum at 1300° C. for 1 hour.
Figure 5A:
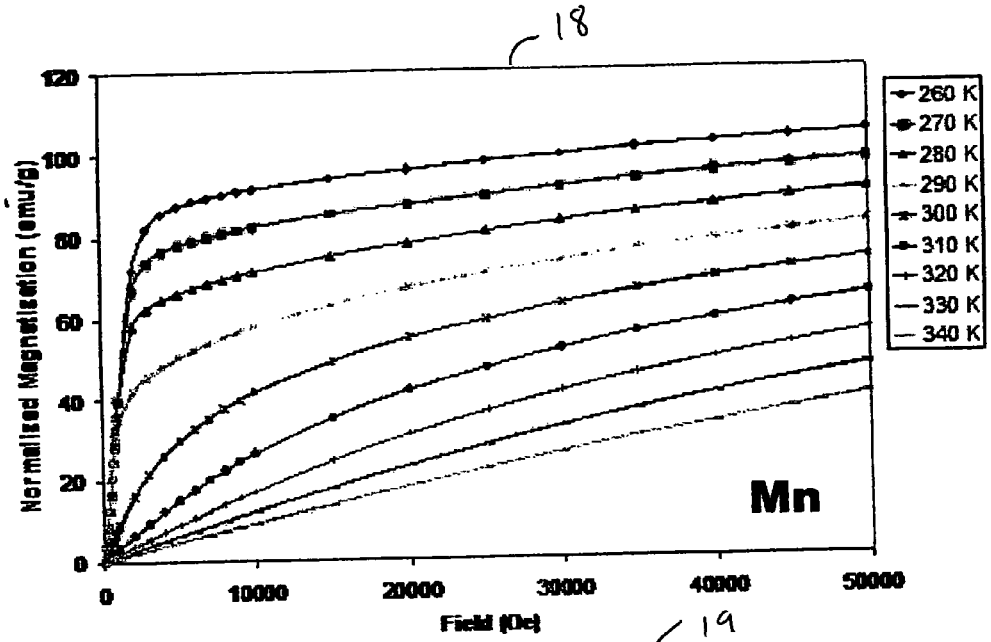
FIGS. 5(*a*)-5(*d*) depict graphs of magnetization versus field loops of the $Gd_5Ge_{1.9}Si_2Mn_{0.1}$, $Gd_5Ge_{1.9}Si_2Ga_{0.1}$, $Gd_5Ge_{1.9}Si_2Cu_{0.1}$ and $Gd_5Ge_{1.9}Si_2Co_{0.1}$ alloy samples heat treated in vacuum at 1300° C. for 1 hour.
Figure 5B:
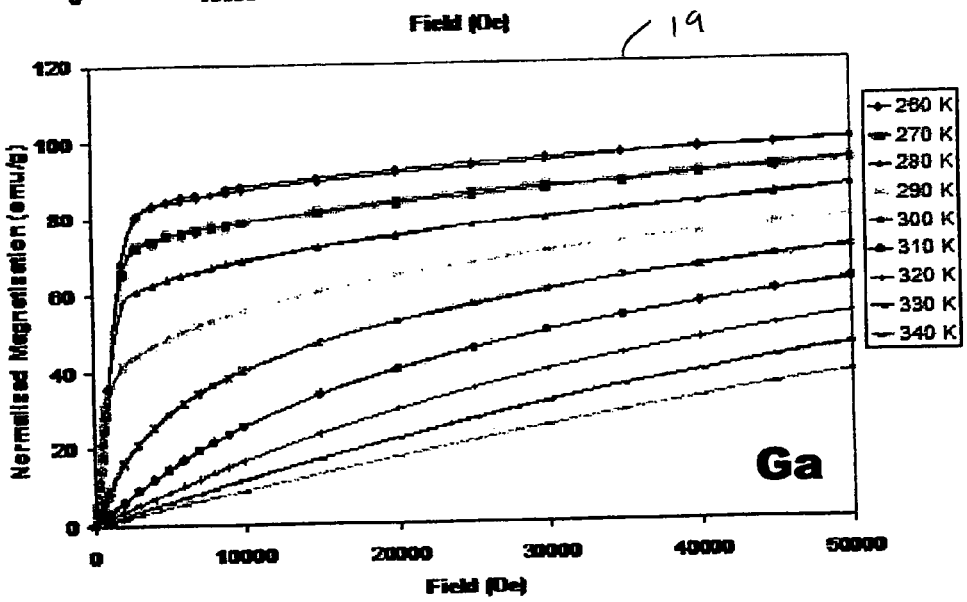
Figure 5C:
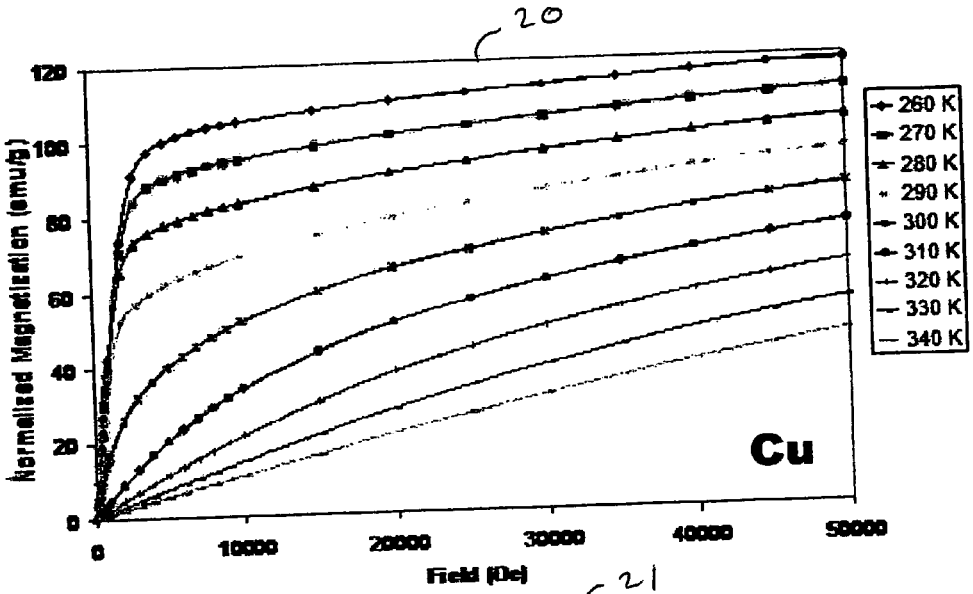
Figure 5D:
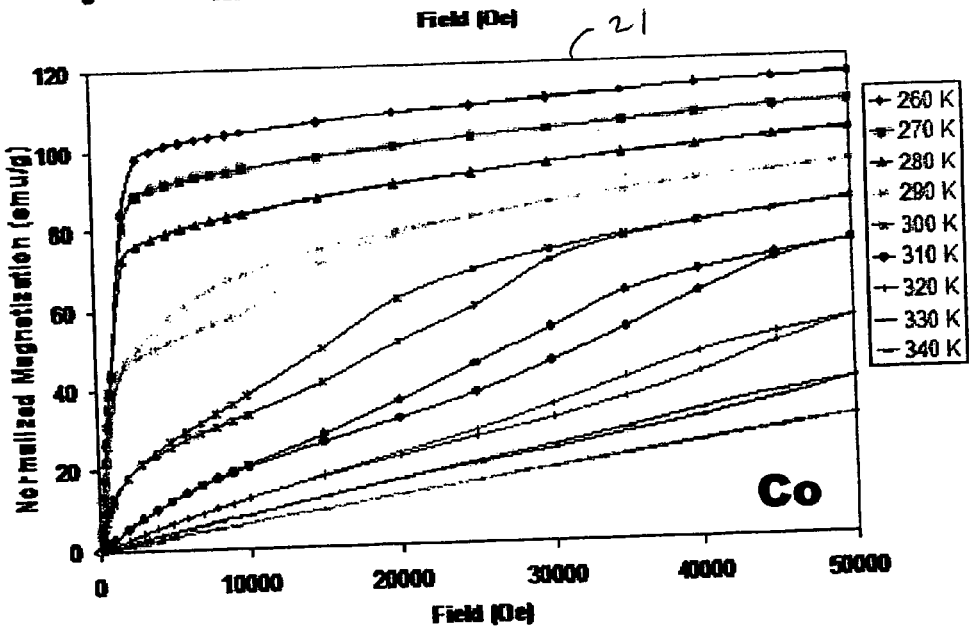

FIGS. 3 and 4 respectively depict graphs of magnetization versus field loops 12, 13 of the heat treated $Gd_5Ge_2Si_2$ compound 10 and of the heat treated $Gd_5Ge_{1.9}Si_2Fe_{0.1}$ compound 11. The hysteresis loops, showing the variation of magnetization, M, as a function of applied magnetic field, H, qualitatively illustrate the corresponding hysteresis losses of the compounds with and without the Fe metal additive in the 260-320 K temperature range. The magnetization versus field loops were obtained by isothermally measuring the magnetization as a function of applied field from 260 to 320 K, at each 10 K interval.

For each loop, the field was cycled from zero to 5 T and back zero. The hysteretic loss values summarized in Table 22 of FIG. 9 provide a quantitative comparison for the metal additive-free alloy and alloys with the Fe metal additive. These hysteresis loss values were determined by computing the area inside each magnetization versus field loop. From this comparison, it can be clearly seen that the addition of about one atom percent iron to the $Gd_5Ge_2Si_2$ alloy resulted in a reduction of the hysteresis losses by more than 90 percent compared to the alloy without any metal additives.

Alloy samples with metal additives other than iron were also prepared according to different embodiments. $Gd_5Ge_2Si_2$ compounds alloyed or doped with Co, Cu, Ga, or Mn metal additives were prepared in the same manner as the $Gd_5Ge_{1.9}Si_2Fe_{0.1}$, i.e. by arc melting the appropriate elemental mixtures, using a water-cooled copper hearth in an argon atmosphere under ambient pressure. Approximately one atomic percent of the metal additive was added to the $Gd_5Ge_2Si_2$ compound. The purity of the starting constituents was 99.9 wt. % and the chemical compositions of the alloy samples were as follows: $Gd_5Ge_{1.9}Si_2Co_{0.1}$, $Gd_5Ge_{1.9}Si_2Cu_{0.1}$, $Gd_5Ge_{1.9}Si_2Ga_{0.1}$, and $Gd_5Ge_{1.9}Si_2Mn_{0.1}$ As in the case of the $Gd_5Ge_{1.9}Si_2Fe_{0.1}$ alloy of the first embodiment, each alloy was homogenized for one hour at 1300° C. in vacuum prior to making magnetic measurements using a SQUID magnetometer.

Referring to FIGS. 2(*a*)-(*d*), which, respectively, depict backscattered SEM micrographs of the heat treated $Gd_5Ge_2Si_2$ compound doped with cobalt, copper, gallium and manganese 14, 15, 16, 17, the $Gd_5Ge_2Si_2$ compounds doped with the metal additives have a microstructure consisting of a brighter dominant matrix phase and a darker minor phase delineating the grain boundaries of the matrix phase unlike the undoped single phase $Gd_5Ge_2Si_2$ compound 10 (FIG. 1).

Referring to FIGS. 5(*a*)-(*d*), which, respectively, depict sets of hysterisis loops 18, 19, 20, 21 showing the variation of magnetization, M, as a function of applied magnetic field, H, for the $Gd_5Ge_{1.9}Si_2Mn_{0.1}$ 17, $Gd_5Ge_{1.9}Si_2Ga_{0.1}$ 16, $Gd_5Ge_{1.9}Si_2Cu_{0.1}$ 15, and $Gd_5Ge_{1.9}Si_2Co_{0.1}$ 14 compounds, these Figures qualitatively illustrate the corresponding hysteresis losses of the compounds with the metal additives in the 260-320 K temperature range. The magnetization versus field loops 18, 19, 20, 21 for these alloys were obtained in the same way as for the $Gd_5Ge_{1.9}Si_2Fe_{0.1}$ compound by isothermally measuring the magnetization as a function of applied field from 260 to 320 K, at each 10 K interval. For each loop, the field was cycled from zero to 5 T and back zero.

The hysteretic loss values summarized in the Table 22 provide a quantitative comparison for the metal additive-free alloy and alloys with the metal additives. From this comparison, it can be clearly seen that the addition of about one atom percent of silicide-forming metals to the $Gd_5Ge_2Si_2$ alloy resulted in a reduction of the hysteresis losses by more than 90 percent compared to the alloy without any metal additives and, for the metal additives Mn, Cu, and Ga the hysteresis losses were nearly or completely eliminated, that is the reduction was nearly 100 percent.

Additional insight concerning the effect of the silicide forming metals on the magnetocaloric response of the $Gd_5Ge_2Si_2$ compound in the 270-320 K temperature range can be obtained by examination of the magnetization versus field loops shown in FIGS. 3, 4 and 5(*a*)-5(*d*). For the undoped $Gd_5Ge_2Si_2$ alloy 10 containing no metal additive (FIG. 3), the magnetization versus field loops 12 show a distinct magnetic transition with increasing field for all temperatures between 270-290 K. Note that this transition occurs at higher field values with increasing temperature. Gschneidner and Pecharsky and their coworkers at Ames Laboratory hypothesized that this transition is the result of a field-induced first order magnetic transition from the paramagnetic monoclinic phase to the ferromagnetic orthorhombic phase. The magnetization versus field loops 12 appear to show that this field-induced transition is reversible upon decreasing field. However, the field at which the reversed transition occurs is smaller than the field required for inducing the original transition. Below 270 K the alloy is ferromagnetic and above 295 K the material is paramagnetic.

By contrast, the magnetization versus field loops 13 of the alloy 11 containing iron (FIG. 4) do not show any field-induced magnetic transition in the 260-320 K temperature range for fields up to 5 T. In this temperature range, in fact, the magnetic data show a gradual shift from a ferromagnetic behavior to superparamagnetic behavior at about 300 K up to up to 320 K; above 320 K the material becomes paramagnetic. As already discussed, the compound without any metal additive becomes paramagnetic above 290 K. In addition, the M versus H data for the quaternary alloys do not indicate the presence of any magnetic transition for T<260 K. Therefore, the behavior of the alloys with and without the metal additives strongly suggests that one of the main effects of either iron or the other silicide-forming metal additives is to suppress the monoclinic-to-orthorhombic field-induced phase transition in the 270-320 K range, resulting in much smaller hysteresis losses.

Figure 6:
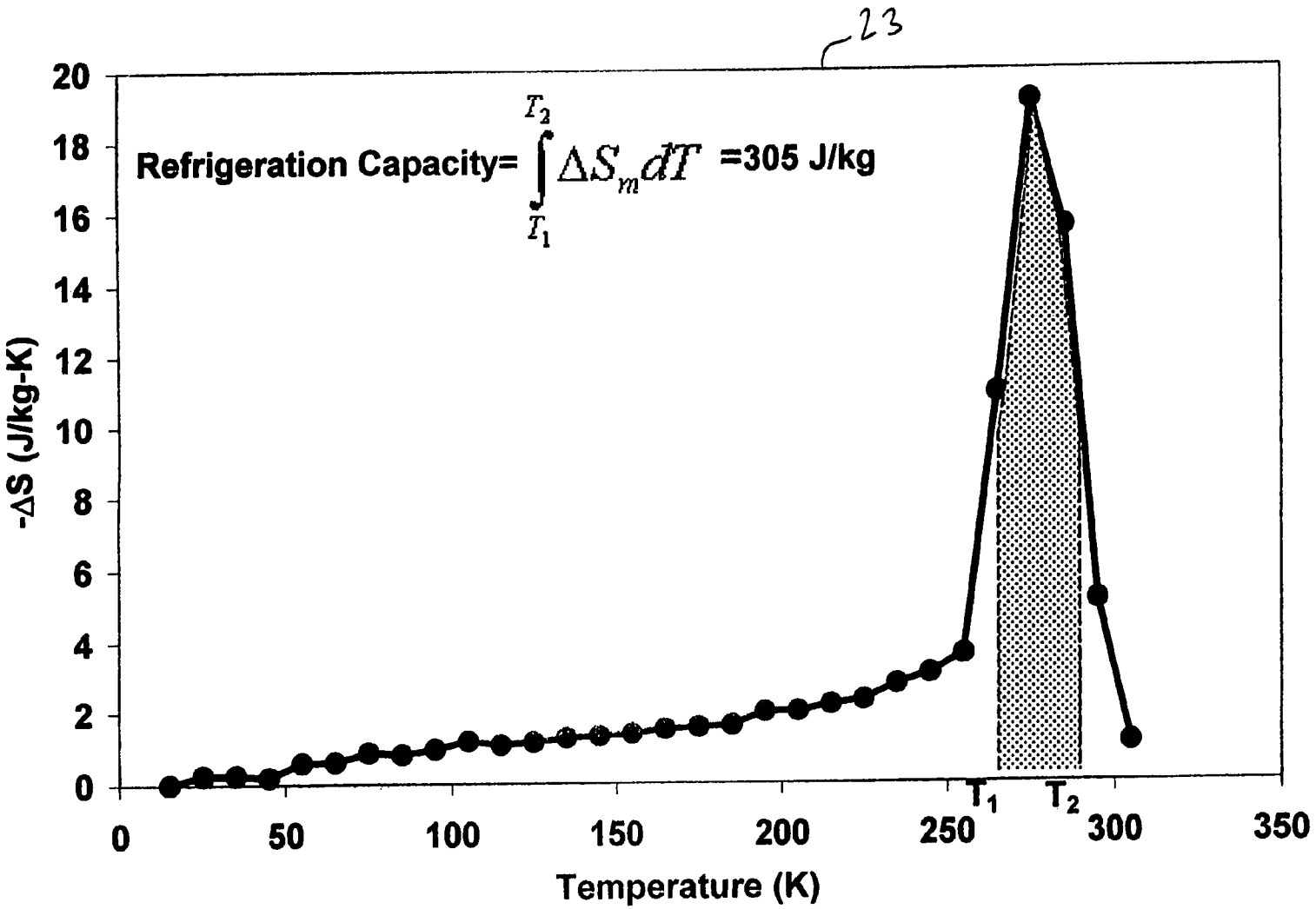
FIG. 6 depicts a graph of computed magnetic entropy change, ΔSm, versus temperature, integrated over applied field ΔH=3980 KA/m (5 T), of the $Gd_5Ge_2Si_2$ compound heat treated in vacuum at 1300° C. for 1 hour.
Figure 7:
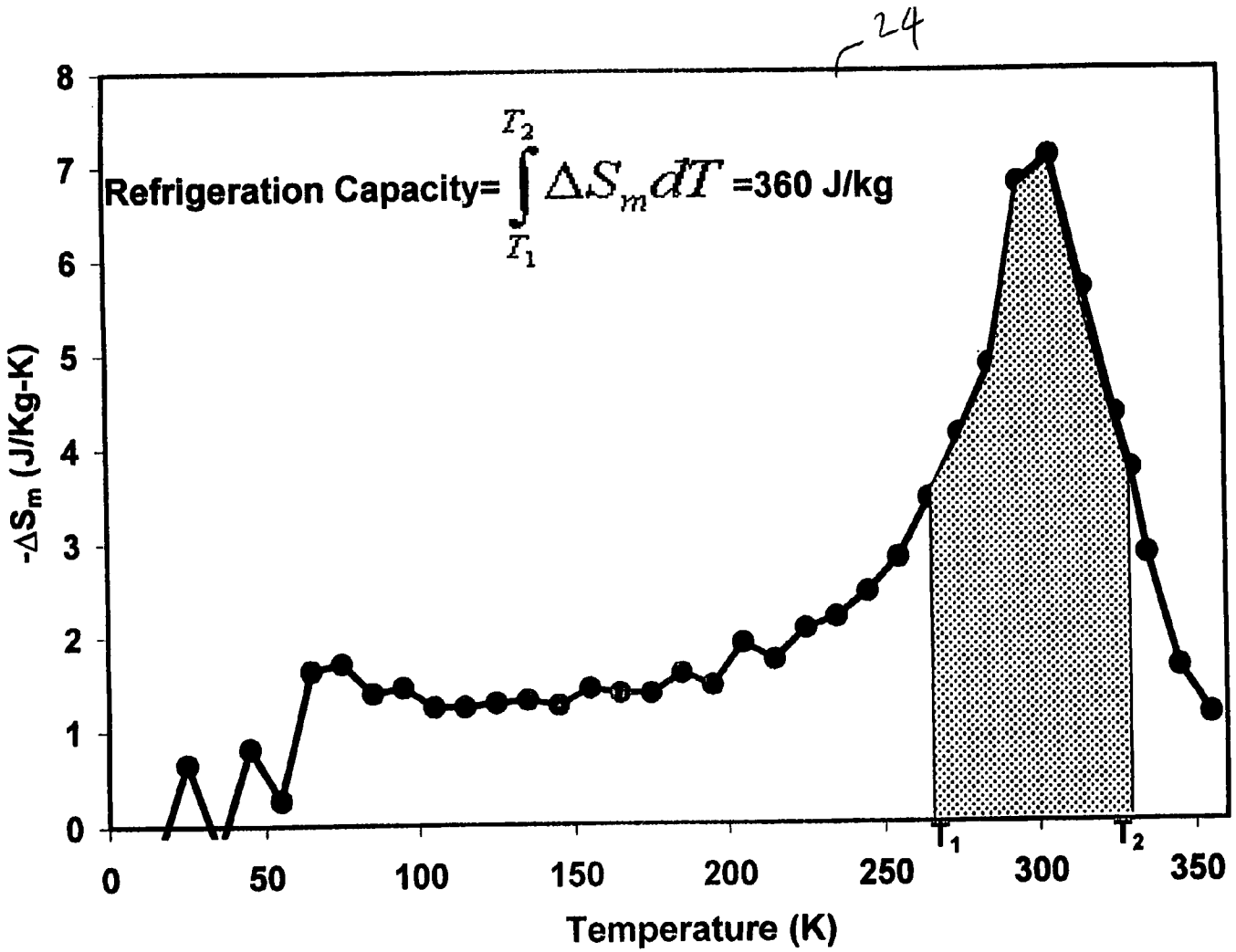
FIG. 7 depicts a graph of computed magnetic entropy change, ΔSm, versus temperature, integrated over applied field ΔH=3980 KA/m (5 T), of the $Gd_5Ge_{1.9}Si_2Fe_{0.1}$ compound heat treated in vacuum at 1300° C. for 1 hour.
Figure 8:
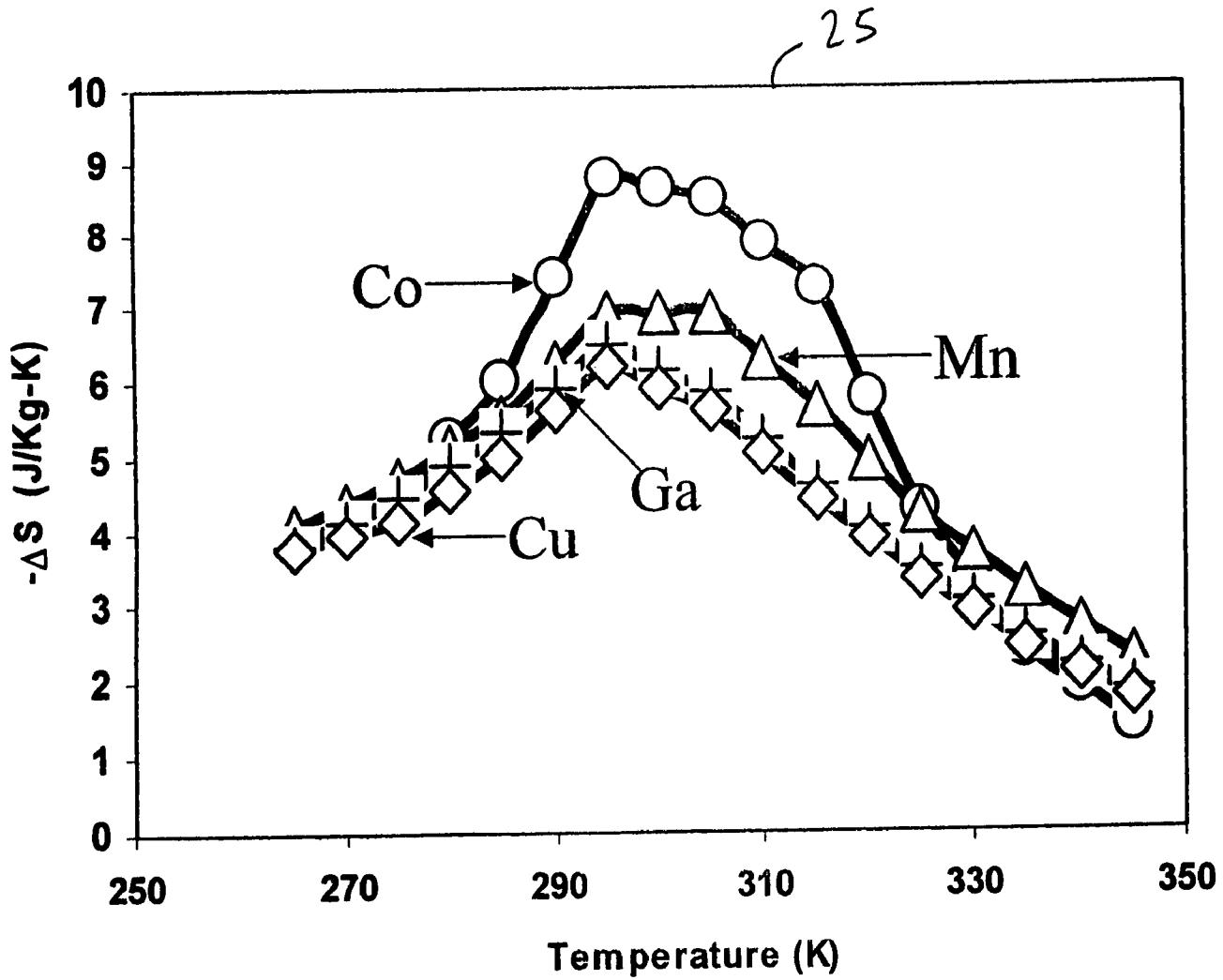
FIG. 8 illustrates computed magnetic entropy change, ΔSm, versus temperature of different $Gd_5Ge_{1.9}Si_2M_{0.1}$ alloys, wherein M=Co, Mn, Cu, or Ga, heat treated in vacuum at 1300° C. for 1 hour.

Referring to FIGS. 6 and 7, which, respectively, depict graphs 23, 24 of computed magnetic entropy change, $\Delta S_m$, versus temperature of the heat treated $Gd_5Ge_2Si_2$ compound and the heat treated $Gd_5Ge_{1.9}Si_2Fe_{0.1}$ alloy, variation of the magnetic entropy change, $\Delta S_m$, with temperature for the metal additive-free alloy and alloy with iron additive is observed. Also, variation of the magnetic entropy change for the alloys with other metal additives is also observed as shown in FIG. 8, which depicts a graph 25 of computed magnetic entropy change, $\Delta S_m$, versus temperature of the different heat treated $Gd_5Ge_{1.9}Si_2Co_{0.1}$ 14, $Gd_5Ge_{1.9}Si_2Mn_{0.1}$ 17, $Gd_5Ge_{1.9}Si_2Cu_{0.1}$ 15, $Gd_5Ge_{1.9}Si_2Ga_{0.1}$ 16, alloys of the embodiments. These data were computed from the isothermal M vs. H data of the alloys, using the integrated form of the Maxwell relation and a numerical integration routine.

The data presented in FIGS. 6-8 clearly show the following significant differences regarding the magnetic entropy change, $\Delta S_m$, as a function of temperature for the alloy without and the alloys with the metal additives. First, for the alloy without any metal additives, the value of the $\Delta S_m$ peak, integrated over an applied field, $\Delta H$=5 T, is about a factor of 3 higher than of the alloys with the metal additives (20 J/kg-K vs. 7 J/kg-K). Secondly, the $\Delta S_m$ peaks for the metal additive-containing alloys are considerable broader (FIGS. 7 and 8). Thirdly, the peak of $\Delta S_m$ occurs at about 305 K for these latter alloys, whereas in the alloy without the metal additives the $\Delta$Sm peak occurs at about 275 K.

From the data presented in FIGS. 6-8, the refrigeration capacity value was computed for each alloy. The refrigeration capacity RC values were computed by numerically integrating the areas under the $\Delta S_m$ vs. temperature curves, using the temperatures at the half maximum of the $\Delta S_m$ peak as the integration limits. Table 22 of FIG. 9 shows computed Refrigeration Capacity (RC) values for the compound $Gd_5Ge_2Si_2$ and for the compound $Gd_5Ge_2Si_2$ doped with the different metal additives according to the embodiments.

A measure of the usefulness of the alloys with and without metal additives as potential magnetic refrigerants is indicated by subtracting from the refrigeration capacity values the corresponding average hysteresis losses and thus obtaining a net or effective refrigeration capacity (NRC): NRC=RC-average hysteresis loss. These hysteresis losses are very small (approximately 4 J/kg or less) and large (around 65 J/kg) for the alloys with and without metal additives, respectively, in the range of temperature where the RC values were computed.

The resulting NRC values are also given in Table 22 of FIG. 9. The significantly higher NRC values and much smaller hysteretic losses of the compounds $Gd_5Ge_2Si_2$ doped with the different metal additives according to the embodiments, clearly demonstrate that the alloys with the silicide-forming metal additives are significantly superior as magnetic refrigerants for near-room temperature refrigeration applications, compared to the alloy without any such metal additives. Adding a silicide-forming metal to the $Gd_5Ge_2Si_2$ compound therefore provides a magnetic refrigerant material highly suitable for near-room temperature applications.

It would be reasonable to conclude that the same mechanism that gives rise to the unusually large magnetocaloric effect is also responsible for the large hysteresis losses: namely, the field-induced crystallographic phase change.

The description as set forth is not intended to be exhaustive or to limit the scope of the invention. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The invention claimed is:

1. A magnetic refrigerant alloy of the general formula:

$$Gd_5Ge_{2-X}Si_2M_X,$$

wherein M is a silicide-forming metal element consisting of iron (Fe) and wherein X=0.1 to thereby provide said magnetic refrigerant alloy having the formula $Gd_5Ge_{1.9}Si_2Fe_{0.1}$;

and wherein said alloy is homogenized by heat treatment.

2. The alloy of claim 1, wherein said alloy is heated at 1300° C.

3. The alloy of claim 2, wherein said alloy is heat treated for 1 hour.

4. A refrigerant compound comprising a $Gd_5Ge_2Si_2$ compound doped or alloyed with approximately one atomic percent of iron (Fe), wherein said iron doped $Gd_5Ge_2Si_2$ compound has the formula $Gd_5Ge_{1.9}Si_2Fe_{0.1}$ and is heat treated so as to homogenize said doped compound.

5. The refrigerant compound of claim 4, wherein said doped or alloyed $Gd_5Ge_2Si_2$ compound comprises arc melted mixtures of said iron (Fe) with said compound elements.

* * * * *